US006286345B1

(12) United States Patent
Kim et al.

(10) Patent No.: US 6,286,345 B1
(45) Date of Patent: Sep. 11, 2001

(54) CARD LOCKING DEVICE

(75) Inventors: Seok-Jin Kim; Dong-Jun Jang, both of Kyonggi-do; Jeong-Wuk Kim, Kyongsangnam-do, all of (KR)

(73) Assignee: New Taecor Co., Ltd., Kyonggi-do (KR)

( * ) Notice: Subject to any disclaimer, the term of this patent is extended or adjusted under 35 U.S.C. 154(b) by 0 days.

(21) Appl. No.: 09/266,946

(22) Filed: Mar. 12, 1999

(30) Foreign Application Priority Data

Mar. 12, 1998 (KR) ..... 98-8197

(51) Int. Cl.[7] ..... E05B 13/00

(52) U.S. Cl. ..... 70/189; 70/218; 70/276; 70/361; 70/387

(58) Field of Search ..... 70/188, 189, 276, 70/361, 387, 352, 218

(56) References Cited

U.S. PATENT DOCUMENTS 2,593,573 * 4/1952 Kulbersh ..... 292/150 X
2,704,934 * 3/1955 Nilsson ..... 70/387
2,732,703 * 1/1956 Noregaard ..... 70/276
3,271,983 * 9/1966 Schlage ..... 70/276
4,475,364 * 10/1984 Frank ..... 292/207 X
4,676,083 6/1987 Sedley et al. ..... 70/276
5,291,766 * 3/1994 Eisermann ..... 70/389 X
5,339,661 * 8/1994 Eisermann ..... 70/276
5,469,723 * 11/1995 Litwin et al. ..... 70/387 X
5,653,134 * 8/1997 Lee et al. ..... 70/276

FOREIGN PATENT DOCUMENTS

2123850 * 11/1972 (DE) ..... 70/387
1188747 * 4/1970 (GB) ..... 70/276

* cited by examiner

*Primary Examiner*—Lloyd A. Gall

(57) ABSTRACT

A card key operated locking mechanism has a connecting mechanism for connecting and disconnecting a locking device with a manual operated handle, a controller for controlling the connecting mechanism in accordance with card key insertion or removal, a latch mechanism to allow the connecting mechanism to maintain connection of the locking device with the handle, and a releasing mechanism to release the latch mechanism upon operation of the handle. The card key operated locking mechanism allows a user to rotate the handle one time upon removal of the card key.

2 Claims, 13 Drawing Sheets

CARD LOCKING DEVICE

BACKGROUND OF THE INVENTION

1. Field of the Invention

The present invention relates to a card locking device, particularly, to a card key operated locking device which can be unlocked one time if a card key has been inserted into a card slot, moved an actuator to an unlocked position and the card key has been moved from the card slot.

2. Discussion of Related Art

A recent technology for a card key locking mechanism is disclosed in detail in Korean Patent Application Publication No. 7221/1990, which is priority-claimed with U.S. application Ser. No. 837,528 filed on Mar. 7, 1986.

A conventional card key locking device(card key door lock), which is currently commercialized, is constructed as shown in FIGS. 1 to 3. An actuator 12 is installed to be movable by a predetermined distance relative to a fixed frame 11 if a card key 10 is inserted into a key slot and is then pushed. If the actuator 12 has been moved down, an impeller 8 which is formed as a unitary body with the actuator 12 pulls a coupling spring 9 in such a manner that a coupling shaft 7 couples two spline shafts 6 and 6', thus coupled with each other. At this time, if a handle grip 5 is turned, a keeper which is coupled with the spline shaft 6' operates to thereby lock or unlock a door.

To prevent the actuator 12 from being returned to the original position (also known as the normal position or the locked position) thereof by the elasticity of a restoring spring 13, even if the force applied on the card key 10 is removed after the card key 10 is inserted and pushed, installation of both a hook cam 4 and a restriction spring 3 are needed. In this case, if the card key 10 is extracted from the key slot, the coupling of the hook cam 4 with the restriction spring 3 is released in such a manner that the actuator 12 is restored to the original position thereof by the elasticity of the restoring spring 13.

Under the construction as discussed above, the conventional card locking device operator should turn the handle grip 5, without delay, to lock or unlock the door, after the card key 10 is inserted into the key slot and the force applied on the card key is in a card key insertion direction to thus move the actuator 12.

If the card key 10 is extracted from the key slot before the handle grip 5 is turned, the handle grip 5 can not be turned. Sometimes a user leaves a card key in the card slot, and without extracting the key the user enters into a room.

SUMMARY OF THE INVENTION

The present invention is directed to a card locking device that substantially obviates the problems due to limitations and disadvantages of the related arts.

An object of the invention is to provide a card locking device where, when a card key is removed from a key slot after the card key is inserted into a key slot and an actuator is thus moved to the unlocked position, the actuator is not restored to the original position without one time performing an unlocking operation. Thus even if the card key is extracted from the key slot after insertion, a handle grip can be turned only one time, so a door is unlocked or locked at one time. Even when the card key is extracted prior to the turning of the handle grip, the handle grip can be turned one time, without re-insertion of the card key.

Another object of the present invention is to provide a card key locking device which has a mechanism so that an unlocking coupling securely is decoupled to a locking position.

According to an aspect of the present invention, there is provided a card locking device including: a flange provided on an end portion of the one side of the actuator; a keeper for locking the flange for preventing the actuator from returning to the original position thereof, when the actuator has been moved by insertion of a card key; and a releasing projection rotated with the rotating shaft and for pushing the keeper to a releasing position in order to return the actuator to the original position, whereby the card key moves the actuator for the rotating shaft to be coupled in operation condition, then the actuator is held in the locked state by the keeper even though the card key is extracted from the card slot unless the rotating shaft finishes its rotation of a predetermined angle.

According to another aspect of the present invention, there is provided a card locking device including: a plunger inserted in a plunger box installed on a lower end portion of the actuator and being supported by a spring; a locking protrusion formed on the fixed frame, for locking the plunger when the actuator is downward over a predetermined distance; a releasing projection rotated with the rotating shaft and for pushing the plunger to a releasing position in order to return the actuator to the original position, whereby the card key moves the actuator for the rotating shaft to be coupled in operation condition, then the actuator is held in the locked state by the plunger even though the card key is extracted from the card slot unless the rotating shaft finishes its rotation of a predetermined angle.

The present invention includes a feature that the keeper comprises a plate spring which is attached on the fixed frame, and has a locking protrusion for locking the flange of the actuator.

The present invention includes a feature that the releasing projection is formed unitary on the rotating shaft or the releasing projection is a circular plate shape fixed to the rotating shaft, having the edge-inclined protruding and reentrant portions, the protruding portion of the releasing projection adapted to push the keeper or the plunger to be separated from the flange or the locking protrusion, and the reentrant portion thereof adapted to have the keeper or the plunger returned to the locking position, if the rotating shaft is rotated to the original position thereof.

The present invention includes a further feature of comprising a pushing portion formed on end of the actuator for pushing a coupling spring when the actuator is returning from the locked state by the keeper to the original position.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

DETAILED DESCRIPTION OF PREFERRED EMBODIMENT

Reference will now be made in detail to the preferred embodiments of the present invention, examples of which are illustrated in the accompanying drawings.

Figure 1:
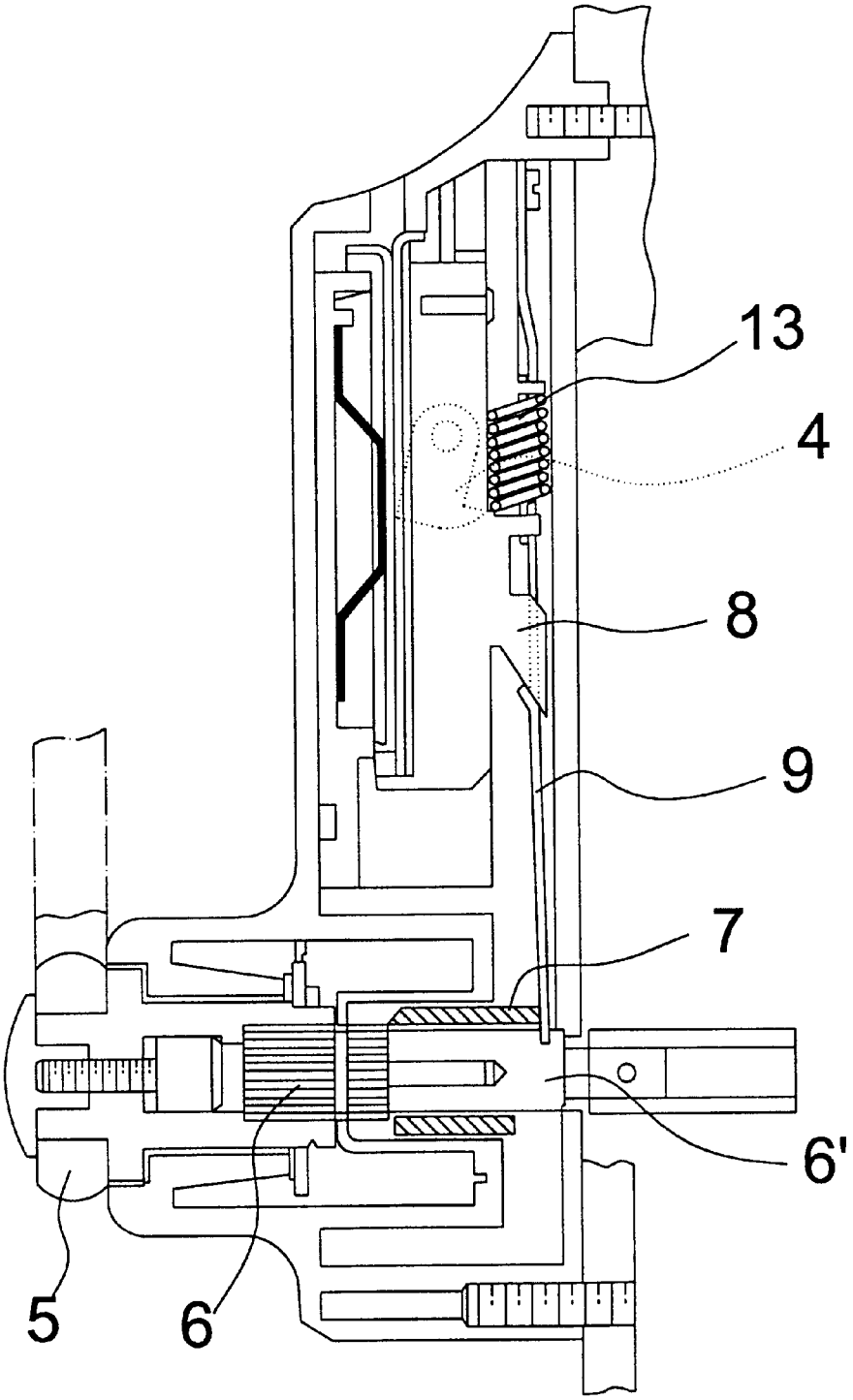
FIG.1 PRIOR ART
FIGS. 1 and 2 are sectional views of conventional card locking devices.
Figure 2:
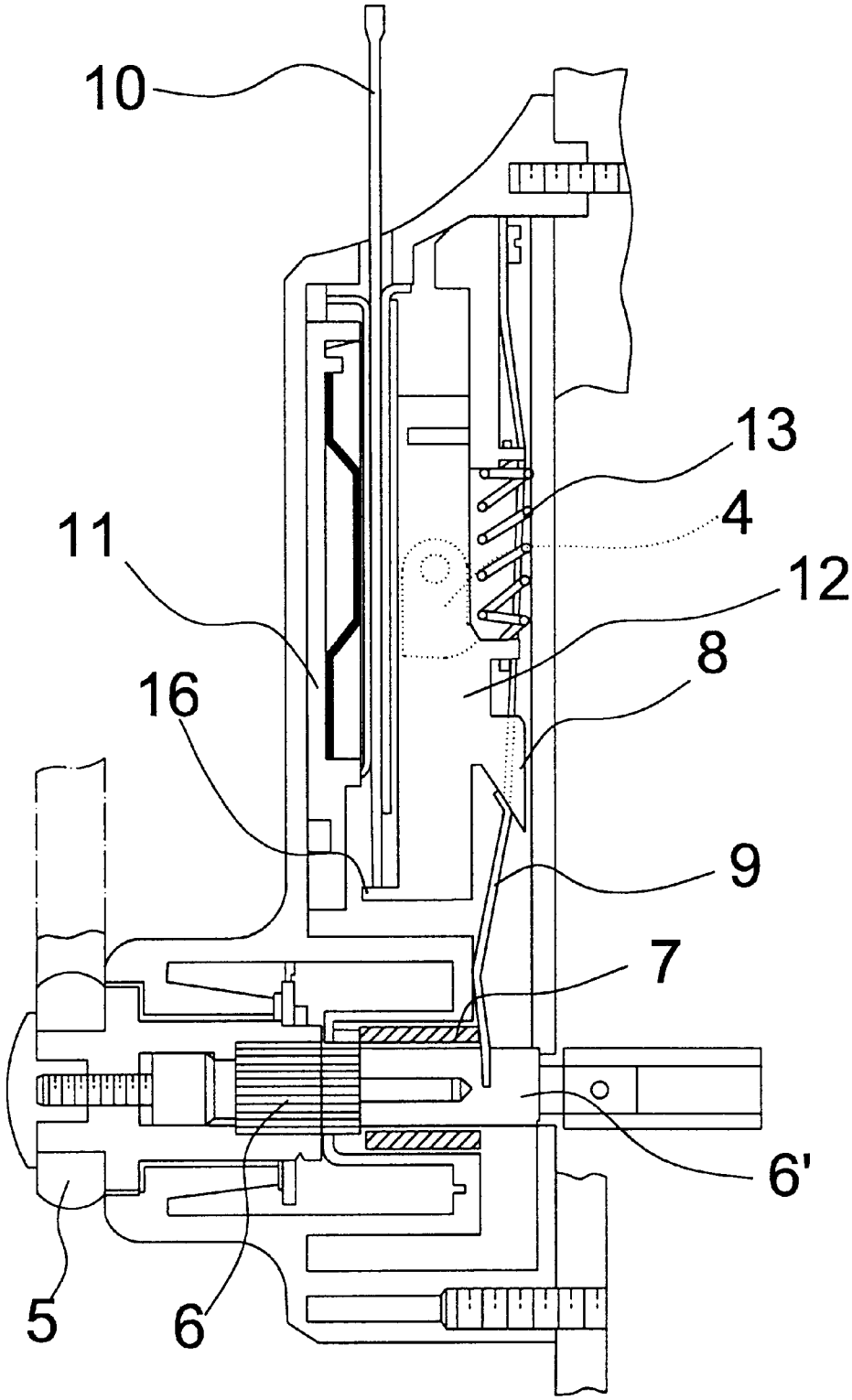
FIG.2 PRIOR ART
Figure 3:
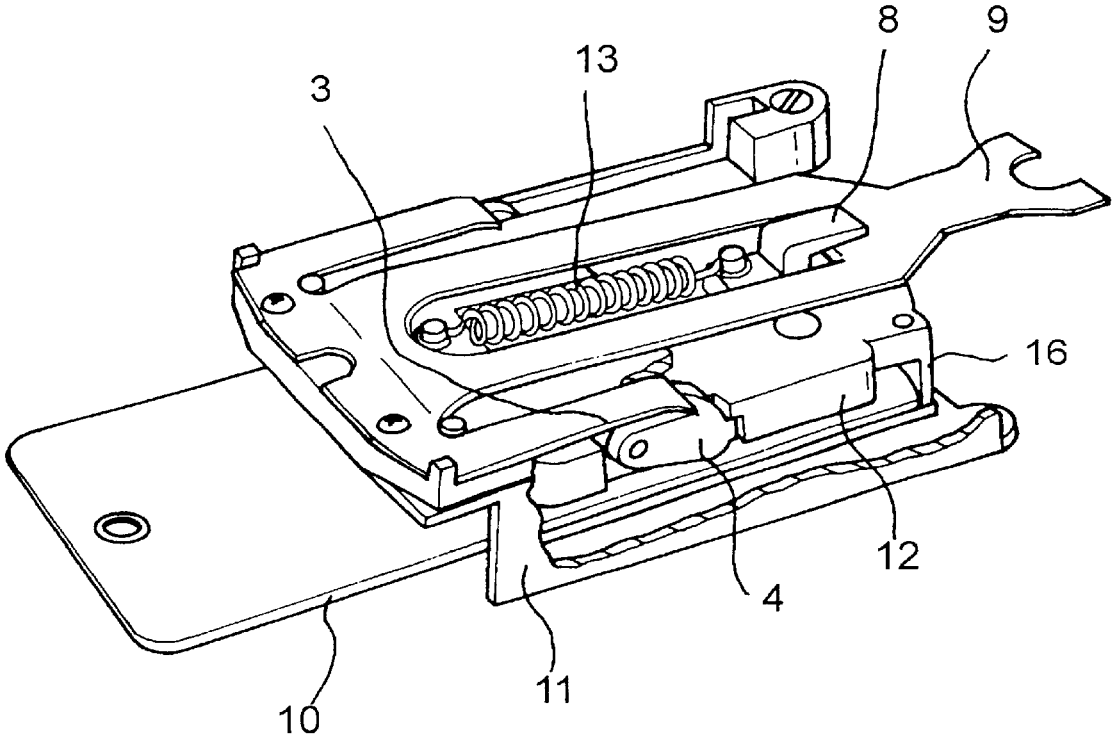
FIG.3 PRIOR ART
FIG. 3 is a perspective view illustrating a part of an actuator of the conventional card locking device.
Figure 4:
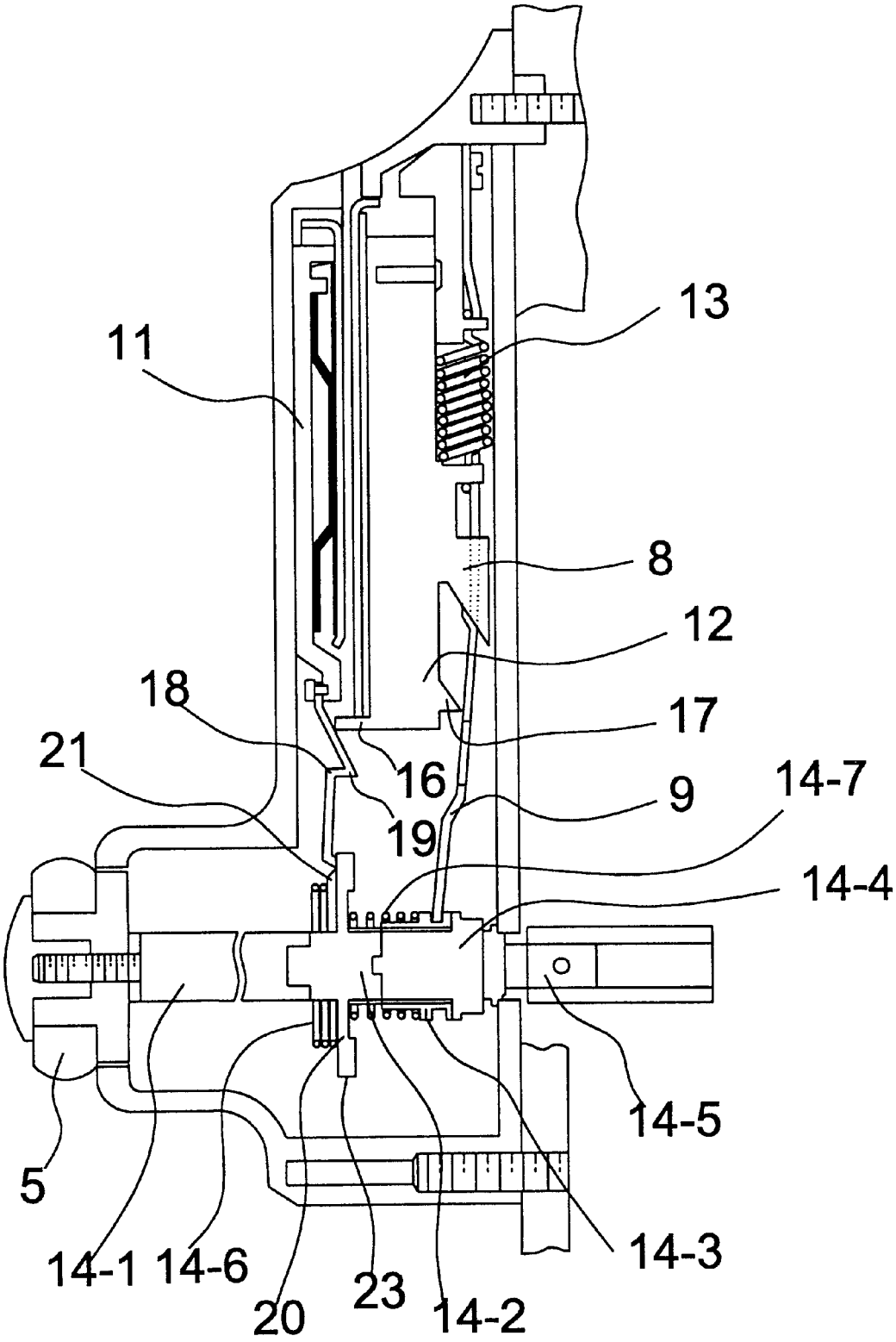
FIGS. 4 to 6 are sectional views of a card locking device according to an embodiment of the present invention.
Figure 5:
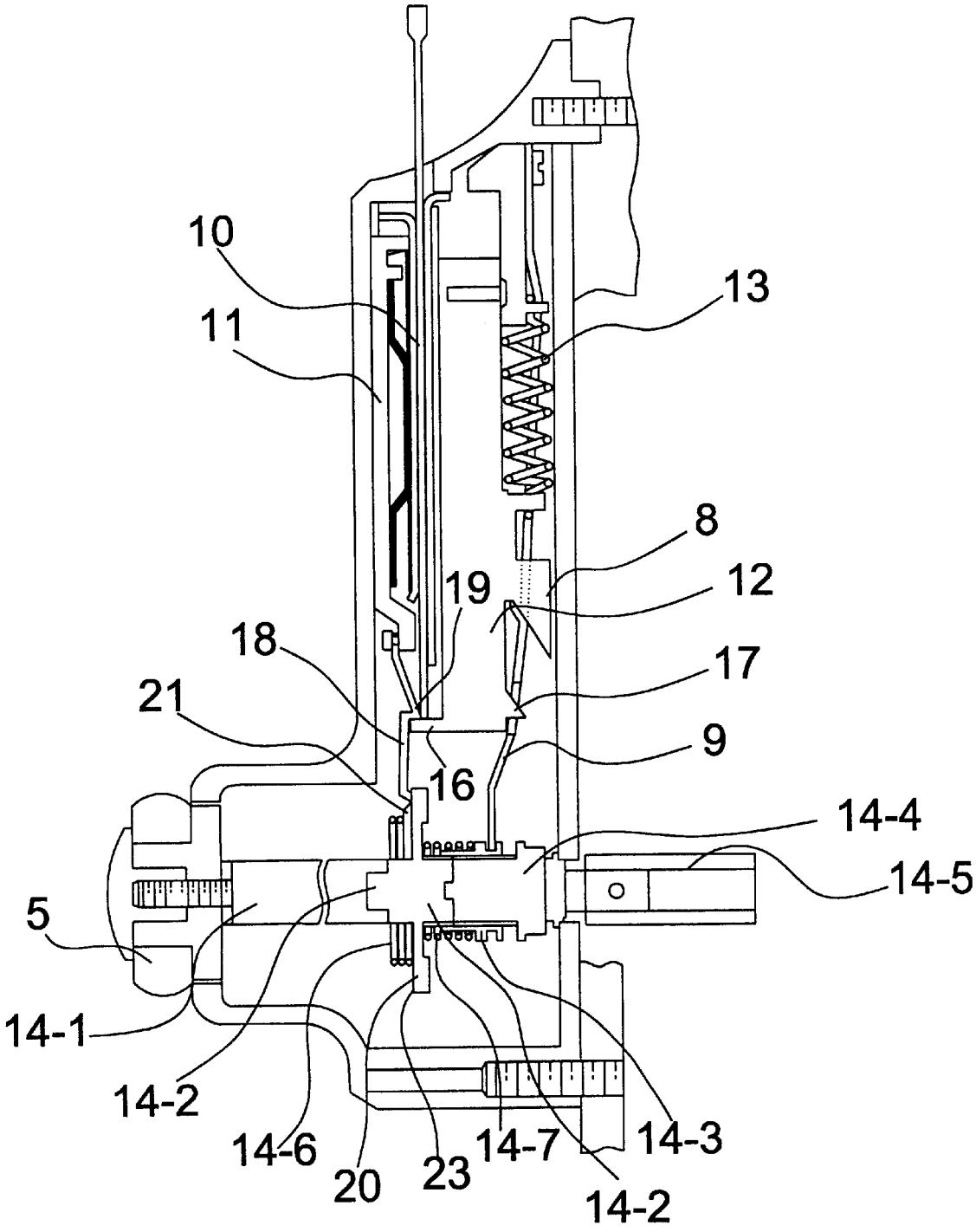

FIGS. 4 to 5 are schematic sectional views of a card locking device constructed according to an embodiment of the present invention. An explanation of the function of the components as mentioned in FIGS. 1 to 3 will be excluded in this detailed description and elements having the same function in the FIGS. 1 to 3 are given the same reference numerals for the sake of brevity.

In the preferred embodiment of the present invention, the hook cam 4 and restriction spring 3 in the conventional art(as shown in FIG. 3) are not used in the present invention. Instead, as shown in FIGS. 4 to 5, a flange 16 is provided on the end portion of the one side of an actuator 12 and a keeper 18 is adapted to lock the flange 16 to thereby prevent the actuator 12 from returning to the original position thereof, when the actuator 12 is moved by the insertion of a card 10 key and a rotating shaft is thus operated.

The actuator 12 stores a cryptic code, and only when the card key 10 inserted coincides with the cryptic code of the actuator 12, it can be moved by the force applied from the card key. This operation is the same as the conventional one. In the same manner as the conventional device, an impeller 8 is formed on the actuator 12 and is coupled with a coupling spring 9. Thus, if the actuator 12 moves in the downward direction, the coupling spring 9 allows a coupling shaft 14-3 to be moved, and thus to couple two spline shafts 14-2 and 14-4.

Figure 10A:
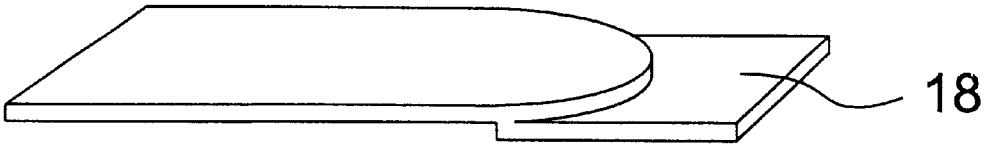
FIGS. 10A, 10B, 10C, 11A, 11B, and 11C are exemplary configurations of a releasing projection of the card locking device according to the present invention.
Figure 10B:
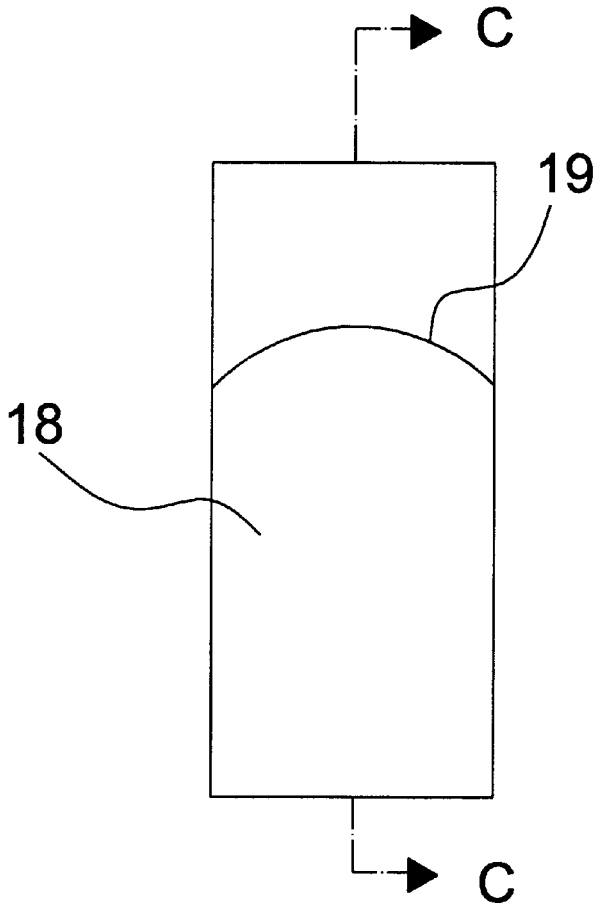
Figure 10C:
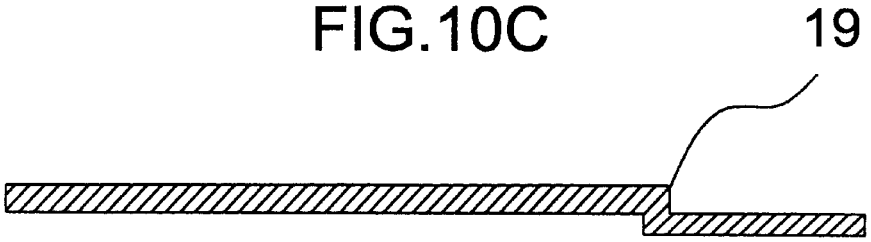

The keeper 18 is fixed to the frame 11 and is made as a plate spring, as shown in FIGS. 10A–10C. This plate spring has a locking protrusion 19 which is curved to correspond with the flange 16 formed in curved shape, so that the flange 16 of the actuator 12 is locked to the plate spring. The locking protrusion 19 may be formed flatly if the flange 16 is formed in a flat shape contacting the locking protrusion 19. The keeper 18 may be used with a locking tool which presses a rotating plate having a locking protrusion by means of a spring.

Figure 12A:
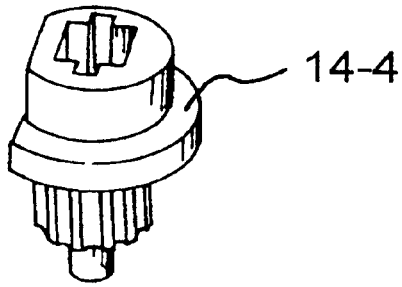
FIGS. 12A, 12B, 12C and 12D are perspective views of elements for locking/unlocking coupling of the present invention.
Figure 12B:
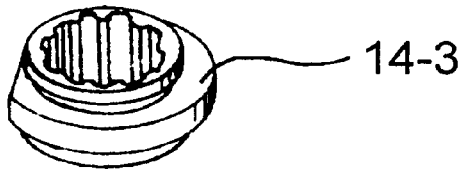
Figure 12C:
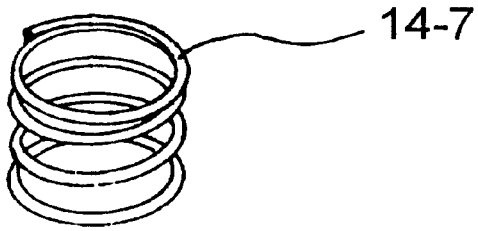
Figure 12D:
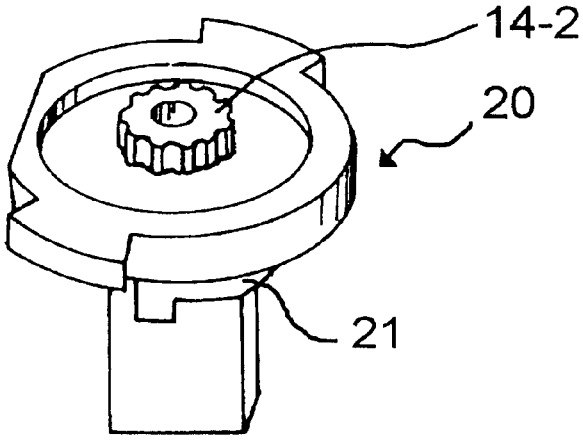
Figure 13:
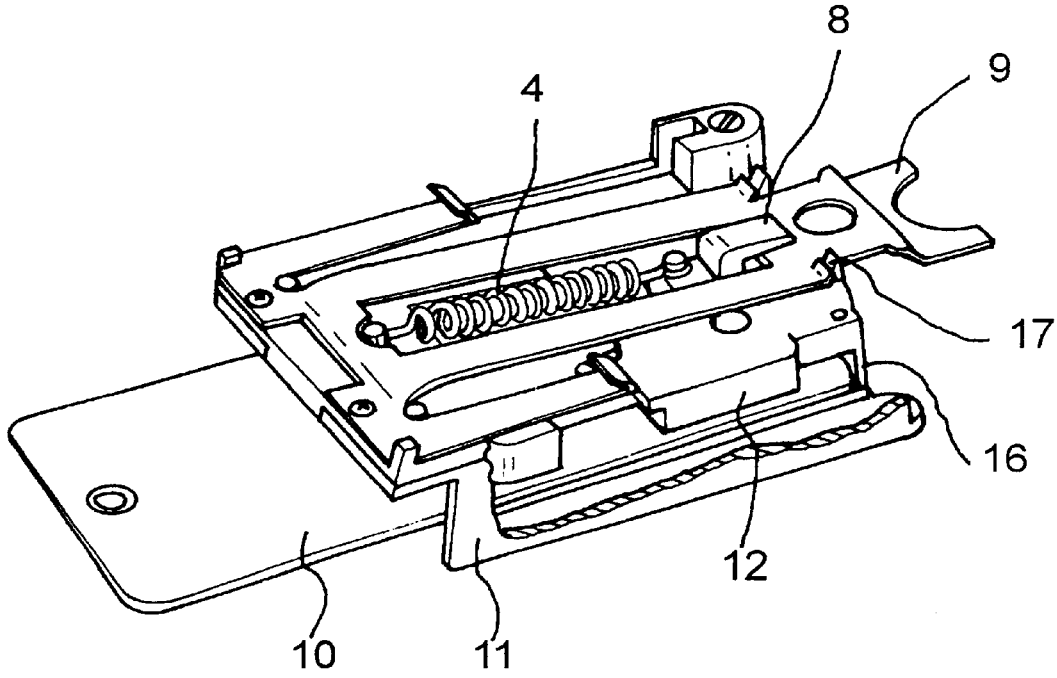
FIG. 13 is a perspective view of the actuator assembly of the present invention.

To release the flange 16 which has been locked to the locking protrusion 19, a releasing projection 20 is formed as a unitary body with the rotating shaft 14-2 as shown in FIGS. 4, 5, and 12*d* thereby pushing the keeper 18 in the opposite direction to the flange 16. The releasing projection 20 has a protruding portion 21 and a reentrant portion 23 on the edge portion thereof. When the reentrant portion 23 is opposite to the keeper 18, the flange 16 is locked to the keeper 18, and contrarily, when the protruding portion 21 is opposite to the keeper 18, the keeper 18 is pushed and the flange 16 is then deviated from the keeper 18.

Figure 6:
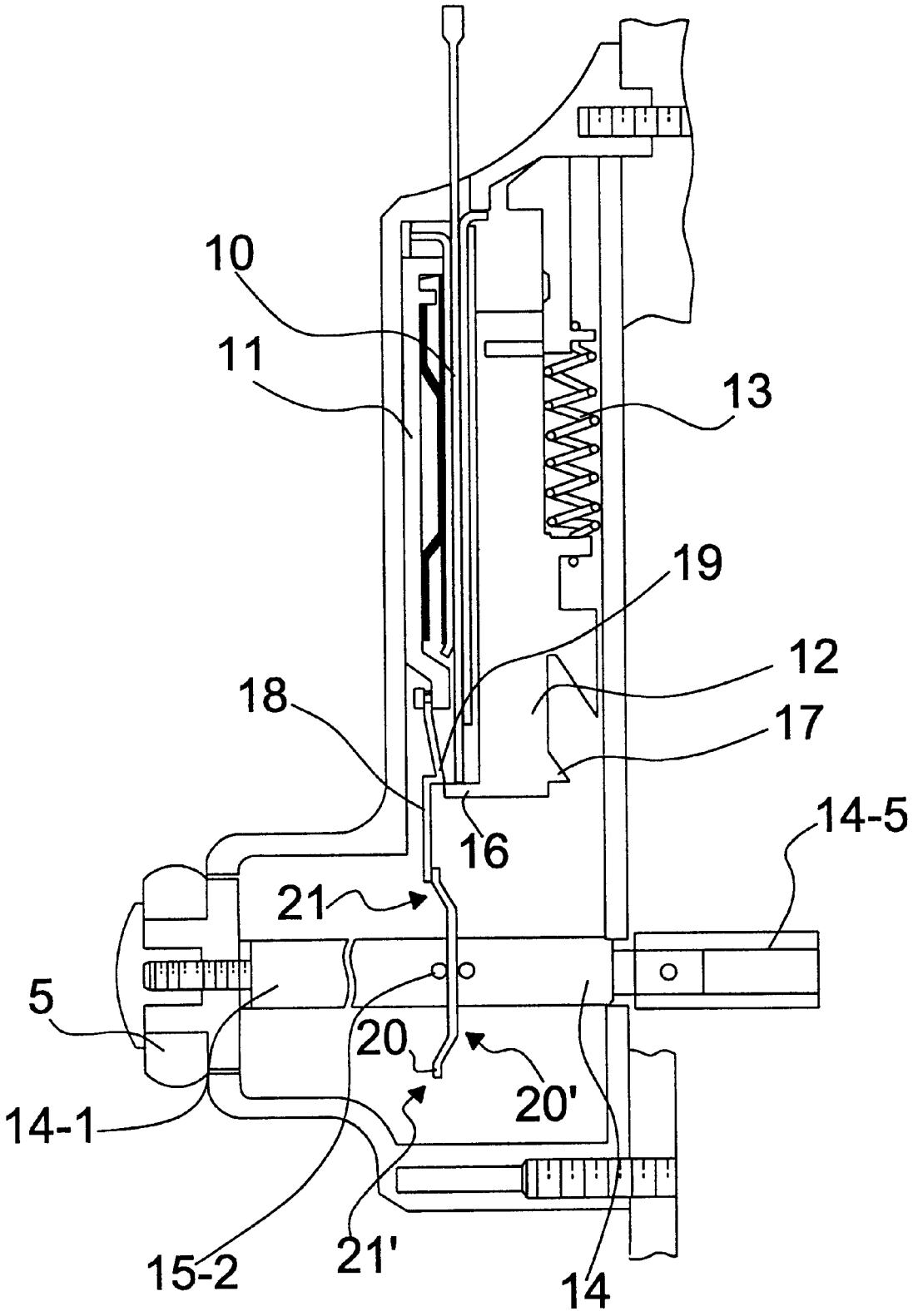
Figure 11A:
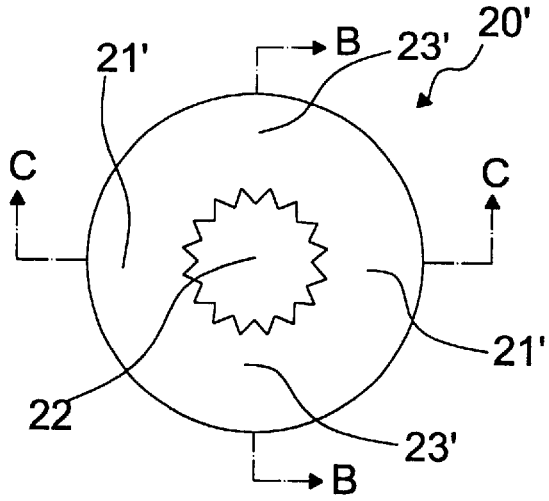
Figure 11B:
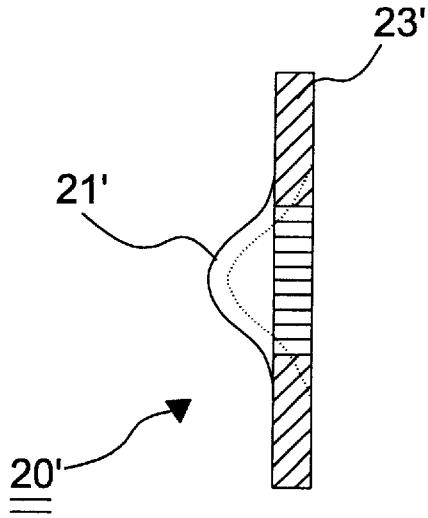
Figure 11C:
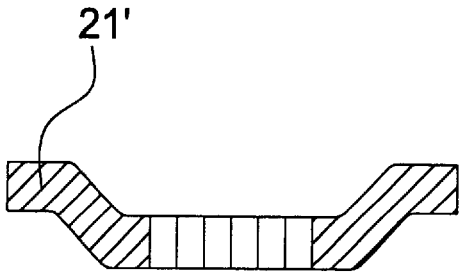

Another example, the releasing projection 20' is formed in a circular plate shape as shown briefly in FIG. 6, and has a tooth-shaped hole 22 on the center portion thereof, through which it can be secured on the spline shaft 14. In this example, the shaft and the coupling spring, etc, are the same as those in the FIG. 4. The method of securing the releasing projection 20' on the spline shaft 14 is an interference fitting method or a position fixing pins 15-1 and 15-2 using method. FIG. 11A is a plan view of the releasing projection 20', FIG. 11B is a sectional view taken along the line B—B of FIG. 11A, and FIG. 11C is a sectional view taken along the line C—C of FIG. 11A. The releasing projection 20' forms a protruding portion 21' and a reentrant portion 23' on the edge portion thereof. When the reentrant portion 23' is opposite to the keeper 18, the flange 16 is locked to the keeper 18, and contrarily, when the protruding portion 21' is opposite to the keeper 18, the keeper 18 is pushed and the flange 16 is then deviated from the keeper 18.

A pushing portion 17 is formed man end of the actuator 12 for pushing a coupling spring 9 while the actuator 12 is returning from the locked state to the normal position.

The rotating shaft 14 coupled to a handle grip 5 on one end portion thereof and on the other end portion of the rotating shaft 14 coupled to a locking shaft 14-5, which is adapted to be connected/disconnected with another locking device to lock or unlock the door. The rotating shaft 14 can have a coupling shaft 14-3, a first spline shaft 14-2, and a second spline shaft 14-4, all not shown in FIG. 6. The releasing projection 20 or 20' can be formed at the first spline shaft 14-2.

The coupling shaft 14-3 has teeth at an inside portion thereof, and the first and second spline shaft 14-2, 14-4 have teeth at an outside portion thereof in the shape of a gear.

In operation, when the card key 10 is first inserted and pushed in the insertion direction thereof, it is checked whether the card key coincides with the cryptic code recorded on the actuator 12. If the card key and cryptic code coincide, the actuator 12 can continue to be moved to lock the flange 16 to the locking protrusion 19 of the keeper 18. After this action, even after the card key is extracted, the actuator 12 is kept in the locked state. In other words, the unlocked state of the actuator 12 as shown in FIG. 4 is changed to the locked state thereof as shown in FIG. 5. The impeller 8 of the actuator 12 forces the coupling spring 9 to move the coupling shaft 14-3 to the first spline shaft 14-2 connected to the handle grip 5 through the connecting shaft 14-1, to thus couple with the second spline shaft 14-4 which is connected with another locking device.

Thus, if the handle grip is turned, a turning torque is transferred to the another locking device, so it can be locked or unlocked.

When the handle grip is turned and the rotating shaft 14 is thus rotated, the protruding portion 21, 21' of the releasing projection 20, 20' pushes the keeper 18, as shown in FIG. 6, and so, the locking protrusion 19 is deviated from the flange 16, to thereby restore the actuator 12 to the original position thereof. The rotating shaft 14 is provided with a rotating spring 14-6 for restoring an amount of rotation thereof. If a manual torque of the rotating shaft 14 disappears, the rotating shaft 14 can be returned to the original position by the rotating spring 14-6, after the locking or unlocking operation. When the actuator 12 is returned to the previous position, the force of the coupling spring 9 pushing the coupling spline shaft 14-3 is reduced, so the coupling spline shaft 14-3 is returned to the previous position. The coupling spline shaft 14-3 is returned to normal position by forces of a pushing spring 14-7 and the coupling spring 9, the force of which is strengthened by the pushing portion 17, While the actuator pushes the coupling spring 9 back. So, the coupling spline shaft 14-3 could be returned to an unblocked state.

Figure 7:
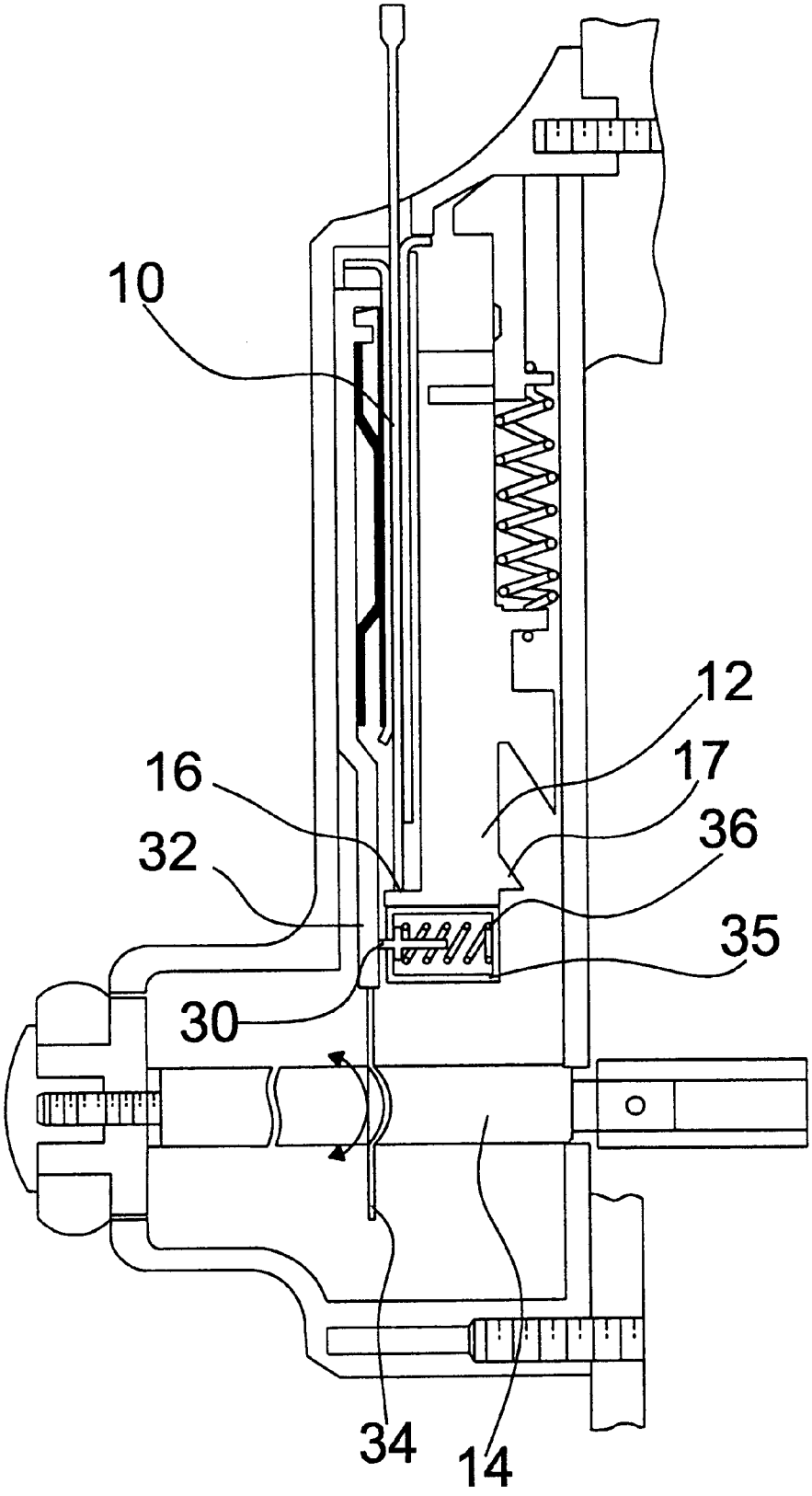
FIGS. 7 to 9 are schematic sectional views of a card locking device according to another embodiment of the present invention.
Figure 8:
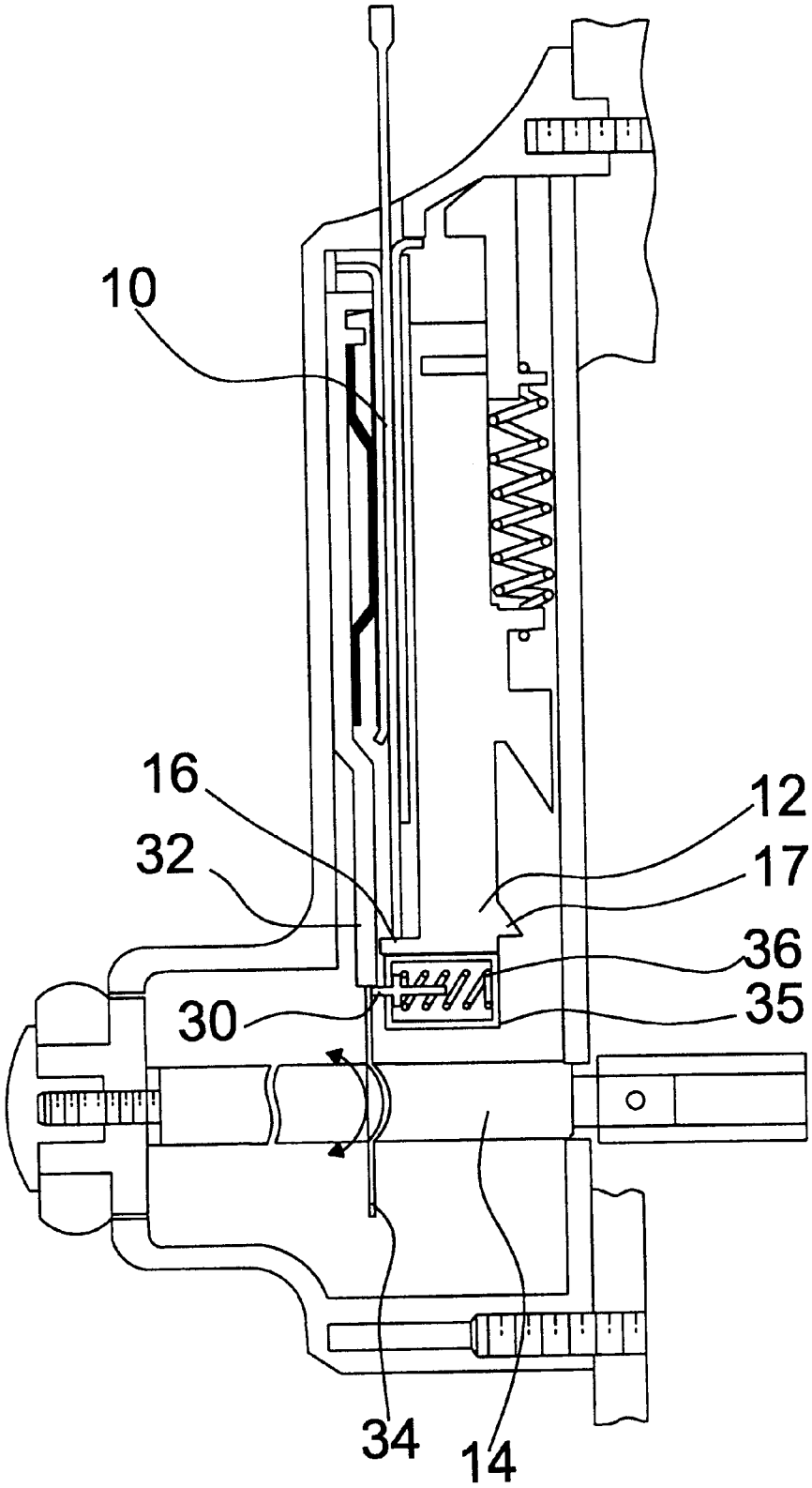
Figure 9:
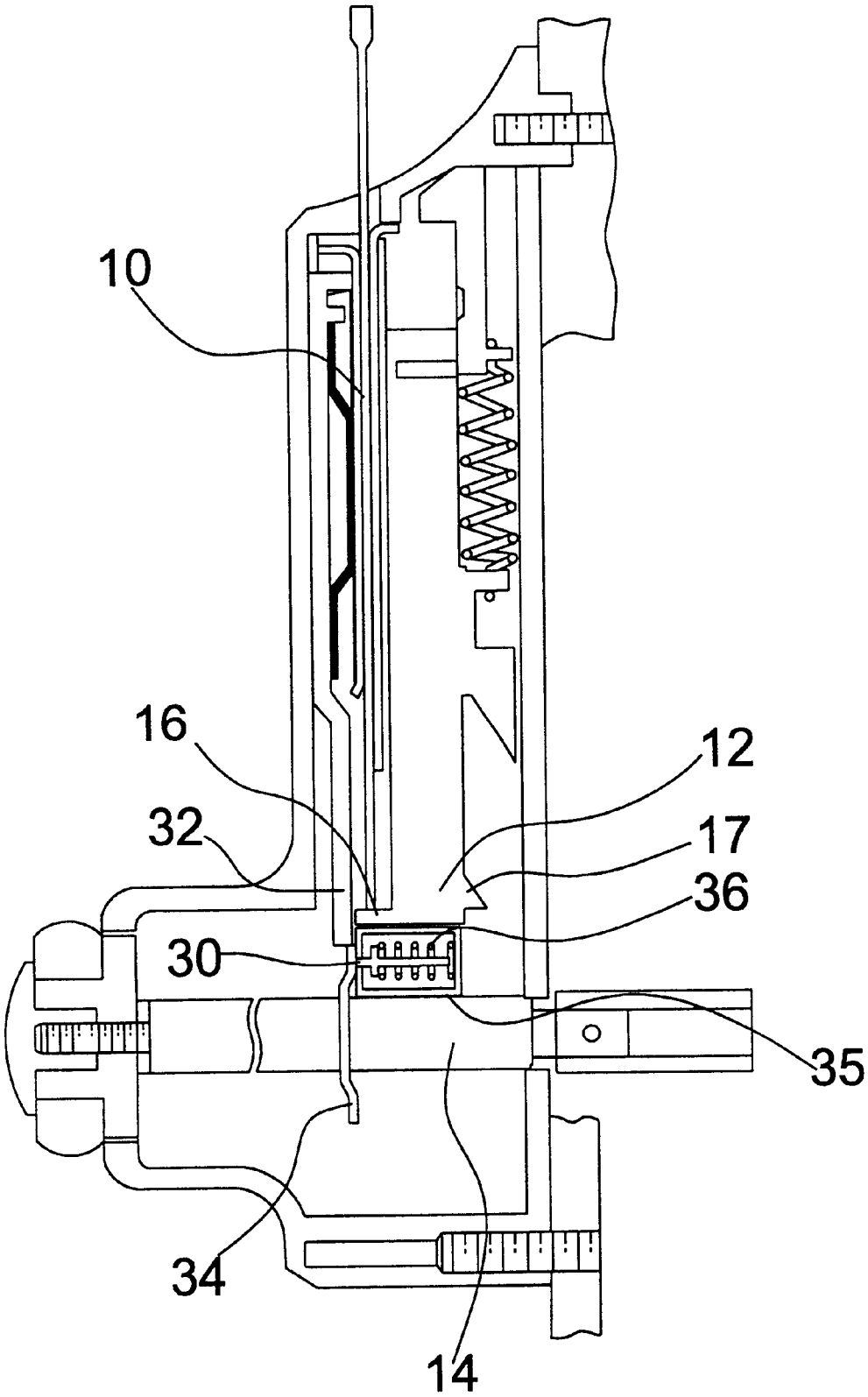

FIGS. 7 to 9 are schematic sectional views of a card locking device constructed according to another embodiment of the present invention. An explanation of the components as mentioned in FIGS. 1 to 3 will be excluded in this detailed description for the sake of brevity. In these drawings, the coupling spline shaft, the coupling spring, etc, are not drawn, but may be the same as those in the FIG. 4, or in the conventional art in FIG. 1 and FIG. 2.

In this embodiment of the present invention, the conventional hook cam and restriction spring(as shown in FIG. 3) are not used. Instead, as shown in FIG. 7, a locking protrusion 32 is formed on the fixed frame to prevent the actuator 12 from being restored to the original position thereof. A plunger device is installed on end of the actuator 12.

The plunger 30 is inserted in a plunger box 35, which is installed on a lower end portion of the actuator 12 and the plunger is supported by a spring 36. The spring 36 which is inserted into the interior of the plunger box 35, and is adapted to support the force exerted to the direction of the locking protrusion 32.

The locking protrusion 32 formed on the frame is for locking the plunger 30 when the actuator 12 is downward over a predetermined distance. When the actuator 12 is moved by the insertion of the card key, the plunger 30 is engaged with the locking protrusion 32. Thus, the rotating shaft 14 comprising the coupling spline shaft, the first and second spline shaft is thus coupled and become in the operation condition.

A releasing projection 34, which is installed rotatably with the rotating shaft 14 a in similar way explained in the previous embodiment. It pushes the plunger 30 to a locking releasing position to thereby restore the actuator 12 to the original position thereof. The releasing projection 34 has a protruding portion and a reentrant portion which respectively take the opposite shape to each other. The configurations of the remaining components of this embodiment are the same as the first embodiment of the present invention. The releasing projection 34 is adapted to push the plunger 30 to the original position thereof, if the rotating shaft 14 is rotated over a predetermined angle(for example, about 60 degrees).

The releasing projection 34 is securely attached to the rotating shaft 14 and is in an edge-inclined circular plate shape, as shown in FIGS. 11A to 11C. The releasing projection 34 has a shaft hole 22 on the center portion thereof, through which it can be secured on the spline shaft. The releasing projection 34 forms a protruding portion 21 and a reentrant portion 23 on the edge portion thereof. When the reentrant portion 23 is opposite to the plunger 30, the plunger 30 is locked to the locking protrusion 32, and contrarily, when the protruding portion 21 is opposite to the plunger 30, the plunger 30 is pushed and then deviated from the locking protrusion 32, to thereby restore the actuator 12 to the original position thereof by the restoring force of the spring.

In operation, when the card key 10 is firstly inserted and pushed in the insertion direction thereof, it is checked whether the card key coincides with the cryptic code recorded on the actuator 12. If coincides therewith, the actuator 12 is moved to lock the plunger 30 to the locking protrusion 32, such that even if the card key is extracted, the actuator 12 is kept in the locked state. In other words, the unlocked state of the actuator 12 as shown in FIG. 7 is changed to the locked state thereof as shown in FIG. 8. The impeller 8 formed on the actuator 12 allows the coupling spring 9 to press the coupling shaft 7 in such a manner that, as shown in FIG. 1 and 2, the spline shaft 6 having the handle grip is coupled with the spline shaft 6' connected with another locking device. Thus, if the handle grip is turned, another locking device can be locked or unlocked. Next, if the handle grip is turned and the rotating shaft 14 is thus rotated over the predetermined angle(for example, about 60 degrees), the protruding portion 21 of the releasing projection 20 pushes the plunger 30, as shown in FIG. 9, and so, the plunger 30 is deviated from the locking protrusion 32, to thereby restore the actuator 12 to the original position thereof. The rotating shaft is provided with a spring for restoring an amount of rotation thereof, if the torque of the rotating shaft disappears. Thus, the rotating shaft can be restored to the original position thereof, after the locking or unlocking operation.

As clearly both fourth in the above, the conventional card locking device should turn the handle grip, without delay, to lock or unlock the door, after a card key is inserted into a key slot and a force applied on the card key is in a card key insertion direction to thus move an actuator. At this time, if the card key is firstly extracted from the key slot before the handle grip is turned, the handle grip can not be turned. Thus, in the state where the card key has been inserted into the key slot, a user enters the door or is out.

On the other hand, a card locking device according to the present invention can prevent, after a card key is inserted into a key slot and an actuator is moved, the actuator from being restored to an original position, even if the card key is extracted from the key slot, while a handle grip is turned and the door is thus locked or unlocked one time, such that even under the state where the card key is extracted prior to the turning of the handle grip, the handle grip can be turned one time, without re-insertion of the card key.

It will be apparent to those skilled in the art that various modifications and variations can be made in a card locking device of the present invention without departing from the spirit or scope of the invention. Thus, it is intended that the present invention cover the modifications and variations of this invention provided they come within the scope of the appended claims and their equivalents.

What is claimed is:

1. A card locking device, comprising:

a connecting mechanism connecting a manual opening mechanism and a locking device in a first state and disconnecting the manual opening mechanism and the locking device in a second state;

a controller controlling whether the connecting mechanism is in the first state or the second state based on interaction with a card key;

a latch mechanism causing the connecting mechanism to remain in the first state after insertion of the card key and until operation of the manual opening mechanism; and a releasing mechanism causing the latch mechanism to release and the connecting mechanism to proceed to the second state upon operation of the manual opening mechanism, the releasing mechanism comprising a circular plate fixed to the connecting mechanism.

2. The device of claim 1, wherein the releasing mechanism further comprises:

an edge-inclined protruding portion and a reentrant portion.

* * * * *